United States Patent [19]

Rendgen

[11] Patent Number: 4,482,791

[45] Date of Patent: Nov. 13, 1984

[54] PUSH BUTTON SWITCH

[75] Inventor: Walter Rendgen, Calw-Hirsau, Fed. Rep. of Germany

[73] Assignee: Robert Seuffer GmbH & Co., Calw-Hirsau, Fed. Rep. of Germany

[21] Appl. No.: 429,155

[22] Filed: Sep. 30, 1982

[30] Foreign Application Priority Data

Feb. 16, 1982 [DE] Fed. Rep. of Germany ..... 3205389

[51] Int. Cl.[3] ..... H01H 13/56

[52] U.S. Cl. ..... 200/153 J; 200/67 B; 200/302.1; 200/340

[58] Field of Search ..... 200/153 J, 328, 302, 200/340, 67 R, 67 B, 5 A; 277/159, 152, 153, 164

[56] References Cited

U.S. PATENT DOCUMENTS

| | | | |
|---|---|---|---|
| 3,337,702 | 8/1967 | Brevick et al. | 200/67 B |
| 3,584,167 | 6/1971 | Nicolas | 200/67 B |
| 3,632,934 | 1/1972 | Flumm | 200/67 B X |
| 3,676,626 | 7/1972 | Mitchell | 200/302 X |
| 3,704,353 | 11/1972 | Halla | 200/153 J |
| 3,821,534 | 6/1974 | Mehner et al. | 200/153 J X |
| 3,973,782 | 8/1976 | Evans | 277/159 X |
| 3,995,129 | 11/1976 | Michalski | 200/67 B |
| 4,112,277 | 9/1978 | Kleeb | 200/153 J |
| 4,161,637 | 7/1979 | Priesmuth | 200/153 J |
| 4,304,416 | 12/1981 | Oshima | 277/152 |

FOREIGN PATENT DOCUMENTS

| | | | |
|---|---|---|---|
| 2413002 | 3/1974 | Fed. Rep. of Germany . | |
| 52705 | 12/1966 | German Democratic Rep. | 200/302 |

*Primary Examiner*—Charles E. Phillips
*Assistant Examiner*—Ernest G. Cusick
*Attorney, Agent, or Firm*—Fleit, Jacobson, Cohn & Price

[57] ABSTRACT

A push button switch comprises a contact rocker member which remains in its actuated position until it is pivoted back into its first position when the actuating push button is actuated again. The actuating button is mounted on the housing and carries a control member which, in the actuated position of the button, co-operates with a latching arrangement on the housing to lock the button to the housing against a return force applied by a tension spring. When the button is actuated again, the control member is released from the latching arrangement on the housing, whereby the switch is automatically switched off.

35 Claims, 7 Drawing Figures

PUSH BUTTON SWITCH

BACKGROUND OF THE INVENTION

The present invention concerns generally a push button switch.

German patent specification No. 2 413 002 discloses a push button switch which comprises a push button supported on a housing. Mounted pivotally in the housing is a contact rocker member which is connected to one end of a tension spring. The rocker member is pivotal between first and second switching positions by a force which is applied to the tension spring by the push button upon actuation thereof, the force engaging the spring transversely with respect to the axial direction of the spring, and the tension spring exerts a return force which causes the contact rocker member to pivot back into its first position from the second or actuated position, when the push button is released. In other words, the contact rocker member is held in the down or second switching position, only for as long as an actuating force is applied to the push button.

SUMMARY OF THE INVENTION

An object of the present invention is to provide a push button switch which does not suffer from the disadvantage of the above-mentioned switch.

Another object of the present invention is to provide a self-release or automatic triggering switch which retains its self-release function even after the switch has been actuated a considerable number of times.

A further object of the present invention is to provide a push button switch which is of a sturdy construction and reliable in operation.

Still another object of the present invention is a push button switch which is rapid in its switching operation.

A still further object of the present invention is a push button electrical switch which is versatile in use and may be for example in the form of a change-over switching device.

These and other objects are achieved by a push button switch comprising a housing supporting a push button. Also mounted pivotally in the housing is a contact rocker member which is connected to one end of a tension spring and which can be pivoted between first and second switching positions by a force which is applied to the tension spring, transversely to the axial direction thereof, by the push button, when the push button is actuated. The contact rocker member can be pivoted from its second switch position back into its first switching position by the return force of the tension spring. The push button is guided or mounted on the housing by means of a control member which, in the second switching position, co-operates with locking or arresting means to lock the push button relative to the housing against the return force of the tension spring, whereby the contact rocker member is arrested in its second switching position until it is pivoted back into its first switching position upon re-actuation of the push button. Thus, when the push button is actuated again, it is released from the arresting or locking means.

In a preferred feature of the invention, the control member comprises an arm carried by the button, with the arm being mounted to the button by means of a spindle on which the arm is fixed or with which it is integral. The spindle is mounted on the button in such a way as to be freely rotatable about its axis, while also having freedom of movement in a direction towards and away from the button, perpendicularly to the axis of the spindle. A spring such as a spring finger engages the spindle, at a position spaced therealong from the arm, so as to urge the spindle towards the button and thereby retain the spindle to the button. The spring may thus engage the spindle at or adjacent one end, with the spindle being supported on the button at its other end, at or adjacent to which the arm is also carried by the spindle.

It will be seen therefore that, even upon wear of the control member, or the co-operating portions of the assembly, with which the control member engages, the biassing force of the spring finger provides a compensating effect to ensure that the switch still operates satisfactorily, even when worn as indicated above. The spring force which acts on the spindle of the control member also provides a basic degree of friction, at the location where the control member is mounted to the push button. The above-mentioned arm which is caused by the spring finger force to engage into a guide groove forming part of the locking assembly on the housing is theefore not unstable, but instead is guided in a stable manner in the guide groove. The point of engagement of the spring finger against the control member may be at a relatively great distance from the means mounting the control member on the push button, so that a relatively low spring force is sufficient to ensure that the arm is stably guided in the guide groove in the housing and to hold the arm in the arresting or locking means when the contact rocker member is in its second switching position, against the return force of the tension spring engaging the contact rocker member. The spring finger which produces the spring biassing effect may therefore have a lower level of spring stiffness, thereby enhancing the service life or operability of the spring over a prolonged period of time. As indicated, the spring may be in the form of a spring finger, with the spring finger carried by the push button and the free end of the spring finger lying against the spindle of the control member. The control member may be made from metal or plastic material, and it may also be made in one piece.

The contact rocker member may be mounted in a knife edge type mounting means provided by a rocker member holder assembly. That configuration of the mounting means may also be employed in a pulse switch wherein, when the push button is released, the return force of the tension spring acting on the contact rocker member moves the latter back into its first switching position. By virtue of the rocker member mounting means being in the form of the knife edge mounting on the holder, electrical contact between the contact rocker member and the rocker member holder is improved so that the rocker member holder may also be in the form of a centre connection, for example in a changeover switching arrangement. The rocker member moves quickly between its switching positions, and in addition, a self-cleaning effect is produced in the knife edge mounting means, upon movement of the rocker member.

The housing of the switch may be closed by a cover or top portion having an opening through which projects an actuating lug or pin fixed to the underside of the push button, for transmitting the force to the tension spring, transversely to the axial direction thereof. The opening in the cover portion may be closed by a suitable sealing member such as a concertina-like seal, which seals between the actuating lug on the underside of the push button, and the edge of the opening in the cover portion. That construction therefore enables the switch to be of a substantially water-tight construction. The sealing member employed may be of such a design as not to affect the arresting or latching moment of the switch.

In one feature of the invention, in the rest position of the push button, the tension spring applies a force to the push button by way of the actuating lug or pin thereof, perpendicularly to the axis of the tension spring, to urge the push button against an abutment means on the housing. That ensures that the push button has a precise rest position.

The above-mentioned arm of the control member may have its lateral surface at least aligned with and not outside the adjoining lateral surface of the push button, which is disposed thereabove. That construction ensures that, when the push button switch is in an installed condition, the arm is protected from lateral contact which could prevent release of the engagement of the arm from the guide groove in the housing.

Other objects, features and advantages of a switch in accordance with the principles of the present invention will be apparent from the following description and claims, and the accompanying drawings.

DESCRIPTION OF THE PREFERRED EMBODIMENT

Figure 1:
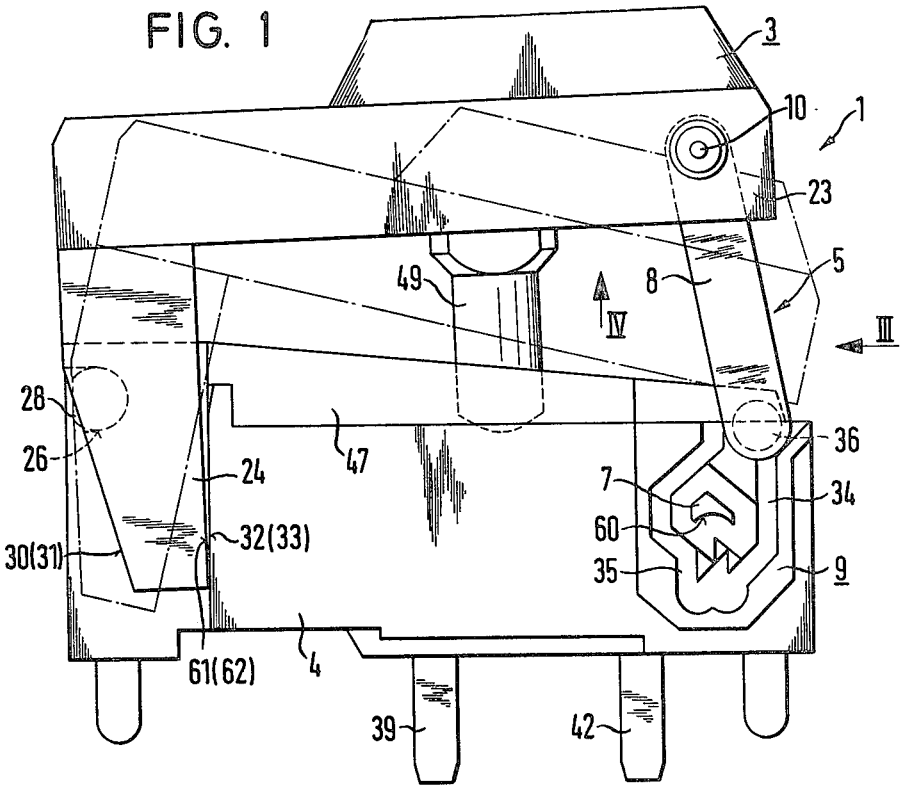
FIG. 1 shows a side view of a first embodiment of a switch in accordance with the principles of this invention.

Referring therefore now to the drawings for a detailed description of a particular preferred embodiment of the switch in accordance with the invention, the form of the switch 1 illustrated therein comprises a housing 4 made of any suitable material. Disposed in the housing 4 is a contact rocker unit 2, which is shown individually in FIG. 6, comprising a contact rocker member 19 which is mounted pivotally in a knife edge-type bearing 37 provided by a rocker member holder or carrier 38 (see FIGS. 6 and 7). The contact member 19 is thus movable by a pivotal movement about the bearing 37, between a first switching position, being an upper switching position as indicated at S1 in FIG. 7, and a second switching position, being a lower switching position as indicated at S2 in FIG. 7. In order for the contact member 19 to pivot from one switching position into the other, the switch 1 includes a push button 3. The push button 3 comprises an actuating portion 23 which is provided with openings 65 and 66 (see FIGS. 3 and 4) for light emitting diodes (not shown) which indicate the position of the switch. Formed on the actuating portion 23 is a pair of mounting limb portions 24 and 25 which are disposed substantially at a right angle to the actuating portion 23, as can be best seen from FIGS. 1 and 3. The mounting portions 24 and 25 are provided on their inward sides with mounting recesses 26 and 27 respectively, into which project mounting pin portions or projections 28 and 29 provided on the housing 4. In order to facilitate mounting the push button 3 to the housing 4, the mounting portions 24 and 25 have inclined or angled surfaces 30 and 31 at their edges which face away from the main part of the housing 4, that is to say, towards the left in FIG. 1. The surfaces 30 and 31 terminate at the recesses 26 and 27, as can be seen from FIGS. 1 and 2. When the button 3 is to be mounted to the housing 4, the mounting projections 28 and 29 are guided along the inclined surfaces 30 and 31 until they then snap into the recesses 26 and 27, whereby the button assembly 3 is pivotally mounted to the housing 4. When the button 3 is fully mounted to the housing 4, bevelled or inclined surfaces 61 and 62 on the mounting limb portions 24 and 25 are adapted to co-operate with abutment surfaces 32 and 33 provided on the housing 4, in order thereby to limit the pivotal movement of the button 3, more particularly in a counter-clockwise direction as viewed in FIGS. 1 and 2. The button 3 is urged in a counter-clockwise direction by the spring biassing force of a tension spring 6 provided on the contact rocker unit 2, in a manner which will be described in greater detail hereinafter, whereby the edges 61 and 62 on the mounting portions 24 and 25 are caused to bear against the abutment surfaces 32 and 33, in the position shown in FIG. 2.

Provided on the underside of the actuating portion 23 of the button 3 is an actuating projection 49 in the form of a pin, peg or the like, which thus projects downwardly from the button 3. The lower free end of the actuating projection 49 engages the above-mentioned tension spring 6, which is in the form of a coil spring, between the two ends thereof, in such a way as to apply a force to the spring 6, transversely with respect to the axial direction thereof. The actuating projection 49 thus bears constantly against the spring 6 so that, as mentioned above, a biassing force is constantly applied to the button assembly 3. The spring will generally be slightly curved along its length, by virtue of the end of the actuating portion 49 bearing thereagainst.

The spring 6 has a first end secured to a fastening peg or projection 56 on the rocker member holder 38, while its other end is connected to the pivotal contact member 19, at a spacing from its engagement with the bearing 37. Depressing the actuating portion 23 of the button 3 thus causes the contact member 19 to be moved from its first position S1 into the second position S2 against the return force of the spring 6, in which movement the contact member 19 goes beyond a dead center position, thus producing a snap-action movement in going from one switching position to the other. The switching position S2 is so disposed that the point at which the spring 6 is connected to the contact member 19 is above the extension of the line connecting the fastening location (fastening projection 56) at which the spring 6 is fastened to the holder 38, and the bearing 37. When the contact member 19 is in that position, the spring 6 applies a return force to the contact member 19, urging it towards the first or upper switching position S1.

In the second or lower switching position S2, an end portion 44 (see FIG. 6) of the pivotal rocker member 19 is so disposed that a downwardly bent portion 45 on the portion 44 bears against a contact abutment member 43 of a contact pin, the contact pressure being produced by the flexing of the spring 6. The spring 6 is flexed or depressed downwardly as viewed in FIG. 2 by the actuating projection 49 carried by the button 3, which is then in a latched or arrested position. The latching action in respect of the button 3 will be described in greater detail hereinafter in connection with a description of the automatic release function of the push button switch.

Figure 3:
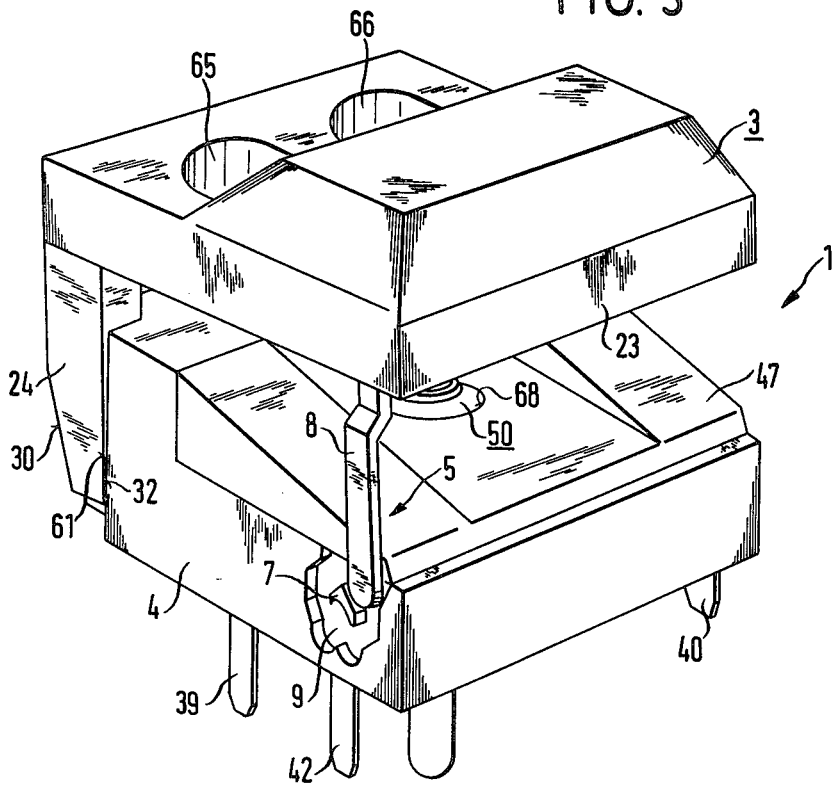
FIG. 3 shows a perspective view of the construction shown in FIGS. 1 and 2, viewing in the direction indicated by arrow III in FIG. 1.

The push button switch illustrated has an automatic release or disconnection function, which is provided by a control or acutating member 5, which can be clearly seen from FIGS. 1 and 3. The control member 5 comprises a shaft or spindle 10 (see now also FIG. 5), and a sensing or follower arm 8 which is secured to or formed on the spindle 10, substantially at a right angle thereto. Disposed at the free end of the arm 8 is a sensing or follower tip or point portion 36.

The spindle 10 of the control member 5 is mounted at the underside of the actuating portion 23 of the button 3. For the purposes of mounting the control member 5, the spindle 10 has a first end 15 which is mounted rotatably in a mounting bore 14 on the button 3, at the side thereof. The end portion 15 of the spindle 10 comprises a short cylindrical part 57 at which the spindle 10 is mounted on the button 3, virtually in the manner of a knife edge-type bearing, and a tapered part 58. The cylindrical part 57 is disposed in a cylindrical bore portion 59 of the mounting bore 14, while the tapered part 58 of the end portion 15 of the spindle 10 is disposed in a tapered or conical portion 13 of the bore 14. That arrangement ensures that the end portion 15 of the spindle can unimpededly pivot in the bore 14, thereby virtually operating as a knife edge-type bearing means.

Figure 4:
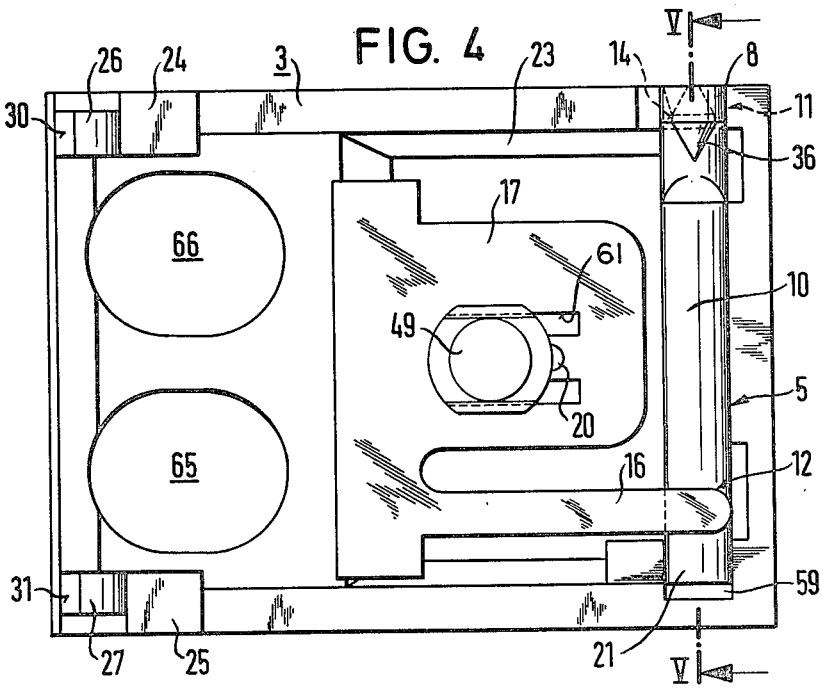
FIG. 4 shows a view of the actuating push button of the FIG. 1 switch, seen from below in the direction indicated by arrow IV in FIG. 1.

At a spacing from the bore 14 which forms a mounting means 11 for the spindle 10, a spring bias force is applied to the spindle 10 and thus the control member 5, by means of a spring 16 which is of a finger-like configuration, as can best be seen from FIG. 4. The spring finger 16 bears against the underside of the spindle 10, being formed on a mounting plate member 17 to which further reference will be made below. It will be seen therefore that the spring force exerted by the spring finger 16 against the spindle 10 causes the spindle 10 to be held in position in a downwardly open recess 59 formed on the underside of the actuating portion 23 of the button 3. The spindle 10 and the control member 5 are thus pivotal, within the open recess 59, about the bearing means 11 formed at the bore 14, against the spring bias force applied to the spindle 10 by the spring finger 16.

Figure 5:
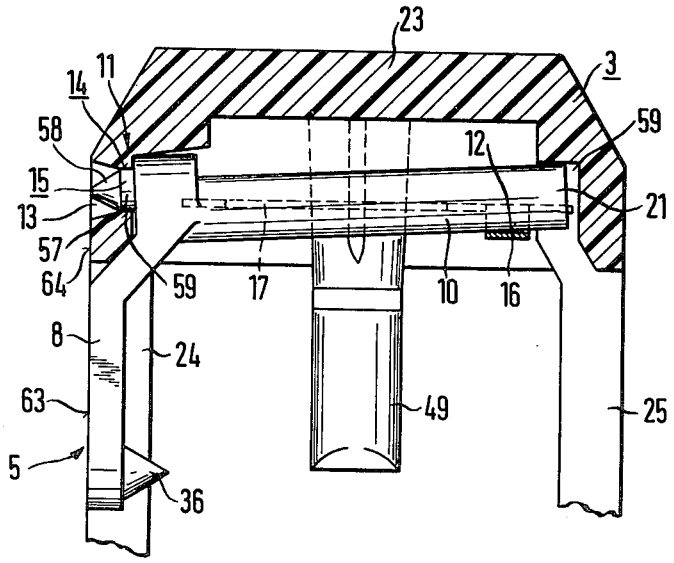
FIG. 5 shows a view of the switch in section taken along line V—V in FIG. 4.

The tip or point portion 36 at the lower free end of the arm 8 of the control member 5 engages into a guide groove or slot 9 on the housing 4, as shown in FIGS. 1 and 3. The engagement of the tip portion 36 in the groove 9 is such that the arm 8 and thus the tip portion 36 are loaded into the groove, by the spring force produced by the spring finger 16. That arrangement ensures that the tip portion 36 is guided in a stable manner in the groove 9, while in addition there is a condition of basic friction at the bearing means 11 as between the spindle 10 and the bore 14, which also contributes to the stability of the guide action in respect of the arm 8 and the portion 36. The lateral surface 63 of the arm 8, as shown in FIG. 5, does not lie outside a corresponding lateral surface 64 of the button 3. As shown in FIG. 5, the surface 63 may be aligned with the surface 64, or it may be displaced inwardly towards the housing 4, relative to the surface 64.

To move the switch from the first position S1 into the second position S2, a pressure is applied to the actuating member 23, to push the actuating member downwardly, together therefore with the actuating projection 49. The projection 49 causes the spring 6 to be flexed or bent in a direction transverse to its axis, so that a force is applied to the pivotal rocker member 19 in a direction transversely with respect to the axis of the spring, that force moving the portion 44 into contact by means of its bent portion 45 with the contact abutment means 43 of the contact pin 42. When the actuating portion 23 of the button 3 is pivoted in a downward direction as viewed for example in FIG. 1, the arm 8 which is pivotally connected by way of the spindle 10 to the free pivotal end of the actuating portion 23, together with the tip portion 36, are moved downwardly in a straight guide portion 34 of the groove 9 so that the tip portion 36 moves into a position in which it is disposed under an arresting or latching means 7 provided in the guide groove assembly 9. The latching means is in the form of a projection in the guide groove 9 and has a curved or bent contact surface 60, for co-operating with the tip portion 36. As soon as the pressure on the actuating portion 23 of the button is released, the tip portion 36 comes to bear against the contact surface 60, being guided by the guide channel portion 34, by virtue of the return force of the spring 6, which acts on the tip portion 36, by way of the control member 5 and the button assembly 3. The tip portion 36 moves laterally along the contact surface 60, in a direction over a second guide channel portion 35 provided in the guide groove 9.

When the switch is to be returned from the position S2 into position S1, the button 3 is depressed again, whereupon the tip portion 36 moves into the guide channel portion 35 which is disposed therebelow. The actuating portion 23 of the button 3 is moved upwardly by the return force of the spring 6, with the pivotal rocker member 19 also being pivoted in a counterclockwise direction in FIG. 2 about the bearing 37, thereby moving the end contact portion 44, 45 away from the contact abutment member 43. In such movement, the arm 8 and the tip portion 36 also move upwardly in the guide channel portion 35. The tip portion moves back into its initial position as illustrated in FIG. 1.

The pivotal movement of the contact member 19 in moving back into the upper switch position S1 is defined and limited by a contact abutment member 41 of a contact pin 40. Under the force applied by the spring 6, the contact member 19 bears against the contact abutment member 41.

Reference is now made to FIG. 4 which shows that the spring finger 16 is formed on or is part of a mounting or holding plate 17, for mounting the spring finger 16 which applies a spring biassing force to the spindle 10 of the control member 5, to the button 3, at the underside thereof. The arrangement of the plate member 17 with spring finger 16 can also be clearly seen from FIG. 2, in its operative association with the button 3. As shown in FIG. 4, the plate member 17 has an opening 61 through which the actuating projection 49 on the underside of the button 3 projects. Disposed in the opening 61 is a holding knife edge member 20) see also FIG. 2 which shows the member 20 in cross-section), whereby the plate member 17 is braced against the actuating projection 49. This arrangement ensures that the plate member 17 does not slide along the actuating projection 49 and come away from the button 3.

Figure 6:
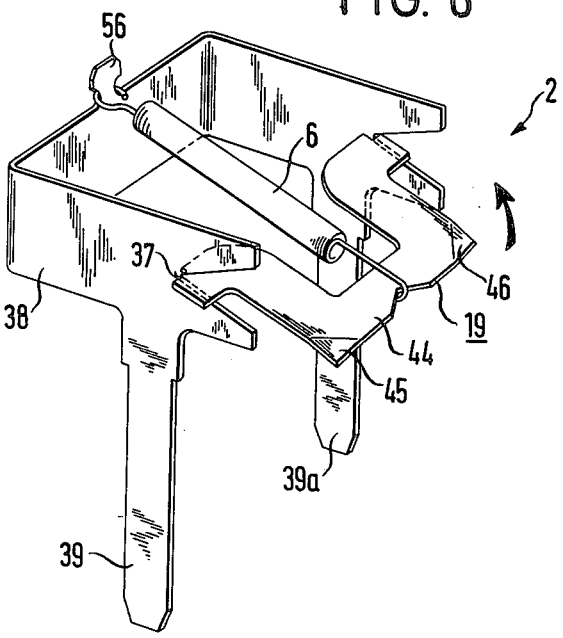
FIG. 6 shows a perspective view of a contact rocker unit used in the illustrated embodiment of the switch.
Figure 7:
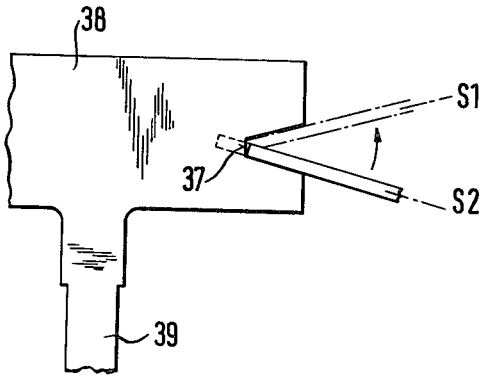
FIG. 7 shows a side view of the mounting of the contact rocker member in its holder.

Referring now also to FIGS. 6 and 7, the holder 38 or the contact rocker unit 2 may be formed as a central connection for a change-over switching device, in such a way that connection pins or legs 39 and 39*a* are formed integrally thereon. The holder 38, the spring 6 and the contact member 19 may be assembled outside the housing 4, and the resulting unit can then be fitted into the housing after it has been assembled. The pins or legs 39 and 39*a* then project through the bottom of the housing 4.

Figure 2:
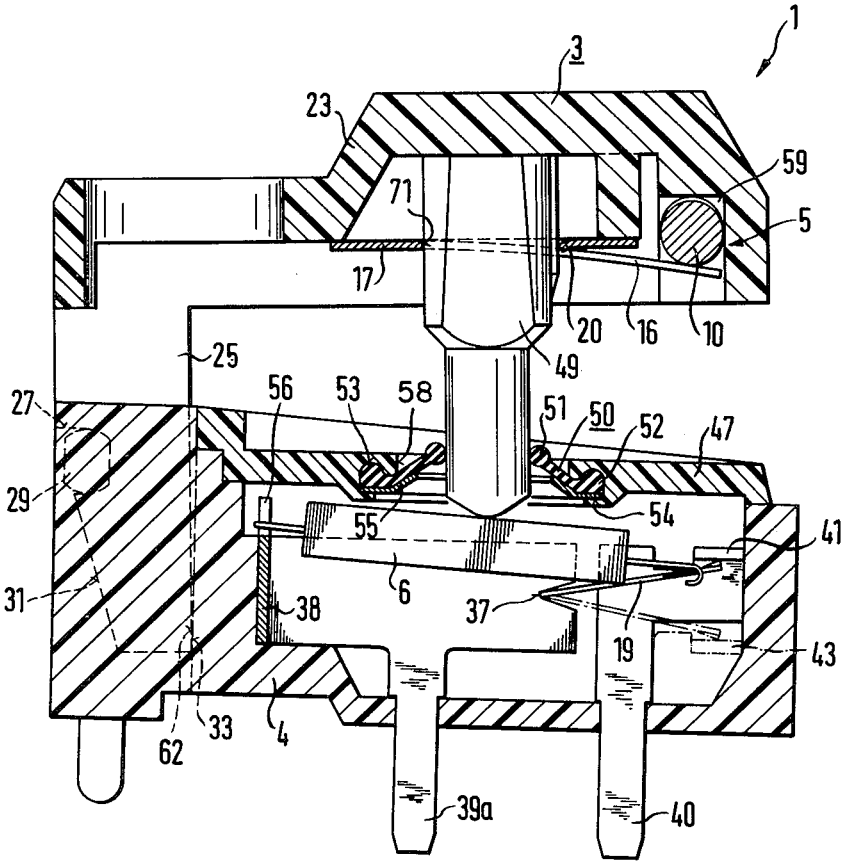
FIG. 2 shows a view of the FIG. 1 embodiment in vertical section.

The push button switch illustrated is made watertight by the provision of a sealing member as indicated at 50, in the form for example of a concertina-type or folding bellows-type sealing member. The sealing member 50 is disposed around the actuating projection 49 which extends through an opening 58 in a cover or top portion 47 of the housing 4, to engage the spring 6. The other end or edge of the sealing member 50 extends around the opening 58 in the cover portion of the housing. In order for one end or edge of the sealing member 50 to be sealingly applied to the actuating projection 49, the sealing member 50 is provided with a sealing ring portion 51 which is biassed against the actuating projection 49. The other edge which is associated with the edge of the opening 58 in the cover portion 47 of the housing 4 is provided with a sealing lip or bead portion 52 which is disposed in a recess 53 around the edge of the opening 58 in the cover portion 47 of the housing 4. The sealing lip 52 is secured in place in the recess 53 by a retaining flange portion 54 which extends around the edge of the opening 58, adjacent the recess 53. A securing disc or ring 55 of the angled configuration shown in FIG. 2 is interposed between the sealing member 50 and the flange portion 54 which is then turned over or otherwise shaped to secure the ring member 55 and the sealing member 50 in place in the recess 52. The operation of turning over or flanging over the flange portion 54 may be effected for example by means of a roll welding step, in which case the flange portion 54 is also welded to the ring member 55. The sealing lip portion 52 is thus pressed into the recess 53 to hold the assembly in place. It will be clear from FIG. 2 that the recess 53 is disposed on the underside of the cover portion 47, which therefore faces inwardly of the housing 4.

It will also be noted from FIG. 6 that the rocker contact member 19 has contact-making portions 45 and 46 at respective corners thereof, the contact portion 45 being for example bent downwardly in order to facilitate contact with the contact member 43 in position S2, while the other contact portion 46 is bent for example upwardly so as to facilitate contact with the other contact member 41 in position S1.

It will be seen therefore that, in operation of the switch described hereinbefore in accordance with the principles of this invention, in order for the switch to constitute an automatic disconnection or tripping switch, the contact rocker member 19 remains in its second switching position S2, after actuation of the switch, until, when the button 3 is depressed again, the member 19 pivots from its second position S2 into the first position S1. The button 3 is guided or mounted on the housing 4, inter alia by means of the control member 5 which thus arrests or latches the button 3 against the return force applied by the tension coil spring 6 to the actuating projection 49 and thus to the button 3, in the second switching position. The control member 5 is then operable to release the button 3 from the latching configuration 7, when the button 3 is depressed again to cause the switch to switch off.

It will be appreciated that, when the control member 5 or portions of the switch assembly which co-operate with the control member suffer from wear, such wear is compensated by virtue of the spring biassing force applied to the spindle 10 of the control member 5, at location 12 thereon, by means of the spring finger 16. The spring biassing force also produces friction at the location at which the control member 5 is mounted to the button 3. By virtue of the spring-loaded arrangement and the resulting friction therefore, the arm 8 which engages into the guide groove arrangement 9 on the housing 4, under the spring biassing force, is guided in a stable manner in the guide groove 9, and is not free to move in an uncontrolled and unstable manner. The location at which the spring biassing force is applied to the control member 5, more particularly at location 12 at the end of the spindle 10 adjacent the recess 59, may be at a relatively long distance from the location at which the control member 5 is mounted to the button 3, as indicated at 11, by means of the bore 13, 14 and the end portions 15, 58 of the control member 5. This means that the spring biassing force may be of a relatively low magnitude for stably guiding the arm 8 in the guide groove assembly 9 of the housing 4, and for holding the arm 8 in co-operation with the latching member 7 when the contact rocker member 19 is held in its second switching position S2, against the return force of the tension spring 6 acting thereon. The reduced spring force required on the part of the spring finger 16 means that the service life of the spring can be increased as it is subjected to a lower level of loading. For similar reasons, the control member may be made of metal or of plastic material, and it may be made in one piece.

The fact that the contact rocker member 19 is mounted on the holder 38 by means of the knife edge-type bearing 37 provides improved contact as between the contact rocker member and the holder 38 so that the holder 38 can form a central connection for example in a switch in the form of a change-over switch. This arrangement also ensures rapid movement of the rocker member between the two switching positions S1 and S2, whle the movement of the rocker member provides a self-cleaning effect in the bearing 37. The configuration of the bearing 37 for mounting the contact rocker member 19 on the holder 38 can also be used in a pulse switch wherein, when the button is released, the return force of the tension spring 6 acting on the contact rocker member returns the contact rocker member to its first position.

Finally, it will be noted that the fact that the surface 63 of the arm 8 does not lie outside the associated surface 64 of the assembly means that the actuating arm 8 is protected from lateral contact which could possibly cause the arm 8 to be disengaged from the guide groove assembly 9, with the result of inadvertent actuation of the switch.

Various other modifications and alterations may be made in the switch in accordance with the principles of this invention, without thereby departing from the spirit and scope thereof.

What is claimed is:

1. A push button switch comprising: a housing; a push button movably supported on the housing; a contact rocker member mounted in the housing pivotally between first and second positions; an elongate spring having a first anchored end and a second end connected to the rocker member, the push button being operable upon actuation thereof to apply to the elongate spring a force which is applied substantially transversely to the direction of elongation of the spring, thereby to cause the rocker member to pivot into its second position, the elongate spring being adapted to apply a return force to cause the rocker member to pivot from its second position into its first position; a control member connecting the push button to the housing and comprising an engagement portion, said control member including an arm mounted on the push button, said arm carried on a spindle rotatably mounted in said push button, and wherein spring biassing means engages said spindle; and arresting means on said housing, adapted to co-operate with said engagement portion on said control member to hold said push button in a position in which said rocker member is held in its said second position, against the return force of said elongate spring, until reactuation of said push button causes said engagement portion of said control member to disengage from said arresting means, whereby said rocker member is pivoted back into its first position by the force of said elongate spring said arresting means comprising a guide groove arrangement having a portion adapted to provide the arresting action upon engagement of said engagement portion of said control member therewith, and a spring biassing means engaging said control member to urge said engagement portion of said control member into said guide groove arrangement.

2. A switch as set forth in claim 1 wherein said spindle is supported by a bearing means on the push button, and a spring force of the spring biassing means engages said spindle at a spacing from said bearing means.

3. A switch as set forth in claim 2 wherein said bearing means is provided at a first end of said spindle and the point of engagement of the spring biassing means on the spindle is disposed adjacent a second end of said spindle.

4. A switch as set forth in claim 3 wherein said spindle is mounted on the push button pivotally about its bearing means against the force of said spring biassing means.

5. A switch as set forth in claim 4 wherein said push button has an open recess means for receiving the second end of said spindle movably therein, said second end being retained in said recess means by said spring biassing means.

6. A switch as set forth in claim 2 wherein said bearing means is disposed adjacent the location at which said arm is carried on said spindle.

7. A switch as set forth in claim 2 wherein said bearing means is disposed at the location at which said arm is carried on said spindle.

8. A switch as set forth in claim 2 wherein said bearing means is a lateral bearing bore in the push button, said bore having a conical portion, said spindle having a first end projecting into said bore in such a way that the end portion of the spindle which projects into said conical portion of the bore is freely movable therein.

9. A switch as set forth in claim 1 wherein said spring biassing means acts transversely with respect to the longitudinal direction of the spindle.

10. A switch as set forth in claim 1 wherein said arm is carried on said spindle substantially at a right angle thereto.

11. A switch as set forth in claim 1 wherein said arm has a free end portion carrying a tip portion forming said engagement portion to engage into said guide groove arrangement.

12. A switch as set forth in claim 1 wherein said spring biassing means is a spring supported on said push button.

13. A switch as set forth in claim 12 wherein said spring is of a finger-like configuration.

14. A switch as set forth in claim 13 wherein said push button comprises an actuating projection adapted to engage said elongate spring as aforesaid and wherein said spring is carried by a mounting plate member supported against said actuating projection by way of a bearing means of knife edge-type.

15. A switch as set forth in claim 14 wherein said spring finger is formed on said plate member.

16. A switch as set forth in claim 14 wherein said spring finger is secured to said plate member.

17. A switch as set forth in claim 1 wherein said arm is urged into said arresting means by said spring biassing means against the return force of said elongate spring.

18. A switch as set forth in claim 1 wherein said push button comprises an actuating body portion and two mounting limb portions which project from said actuating body portion, each of said mounting limb portions having an inward surface towards said housing, provided with a respective recess therein, wherein said housing has mounting portions adapted to engage into respective ones of said recesses, and wherein each mounting limb portion has an inclined surface terminating at respective said recesses thereby to facilitate engagement of the respective mounting portion into the associated recess upon assembly of the push button to the housing.

19. A switch as set forth in claim 1 wherein said arresting means comprises an arresting portion engageable by said engagement portion of said control member and guide channels extending in the direction of actuation of the assembly and on each side of the arresting portion, such that, upon movement of the rocker member into its second position, said engagement portion is guided in one of said guide channels into engagement with said arresting portion, and said engagement portion on engaging with said arresting portion is displaced laterally with respect to the direction of actuation thereof to another of said guide channels and, when the rocker member moves into its first position, the engagement portion is released from the arresting portion and returned via another of said guide channels into its initial position by the return force of said elongate spring.

20. A switch as set forth in claim 1 wherein said push button comprises an actuating projection adapted to engage said elongate spring and wherein said housing includes a cover means having an opening through which projects said actuating projection, said cover means serving to close said housing at its side toward said push button.

21. A switch as set forth in claim 20 wherein said opening in said cover means is closed by a sealing means disposed around the actuating projection extending through said opening.

22. A switch as set forth in claim 21 wherein said sealing means has a first edge, a sealing ring at said first edge, adapted to bear sealingly against said actuating projection, a second edge, and a sealing lip at said second edge, said sealing lip being fitted into a recess around the opening in said cover means, and wherein a flange portion associated with said recess secures said sealing lip in said recess.

23. A switch as set forth in claim 22 wherein an annular fixing disc is secured between said flange portion and said sealing lip.

24. A switch as set forth in claim 23 wherein said disc is welded to said flange portion.

25. A switch as set forth in claim 21 wherein said sealing means is in the form of a bellows-type sealing member.

26. A switch as set forth in claim 1 wherein said contact rocker member is mounted by a knife edge bearing means of a rocker member holder.

27. A switch as set forth in claim 26 wherein said rocker member holder has electrical connecting means thereon.

28. A switch as set forth in claim 1 wherein said first end of said elongate spring is secured to a means mounting said rocker member.

29. A switch as set forth in claim 28 wherein said rocker member mounting means has connecting pin portions for connecting said switch to an electrical circuit.

30. A switch as set forth in claim 1 and further including a contact pin against which the rocker member bears in the first position and which has a contact abutment means for limiting the movement of the rocker member towards its first position, contact making occurring by way of said contact abutment means, and further including a second contact pin against which said rocker member bears in said second position, the second contact pin having a contact abutment means for limiting the movement of the rocker member towards its second position.

31. A switch as set forth in claim 30 wherein said rocker member has a first contact portion which extends at least partially towards said first position thereof and a second contact portion which extends at least partially towards said second position.

32. A switch as set forth in claim 1 wherein said housing comprises an abutment means defining a rest position of said push button, said push button being urged into contact with said abutment means by the force of said elongate spring.

33. A switch as set forth in claim 32 wherein said push button comprises mounting limb portions mounting said push button on said housing and having edge portions adapted to bear against the abutment means in the rest position of the push button.

34. A switch as set forth in claim 1 wherein said arm has a lateral surface which is at least aligned with a corresponding lateral surface of the push button which is disposed thereabove.

35. A switch as set forth in claim 34 wherein said lateral surface of said arm is disposed inwardly of said lateral surface of said push button.

* * * * *